United States Patent [19]

Roberts

[11] Patent Number: 4,894,581

[45] Date of Patent: Jan. 16, 1990

[54] TABLE AND CABINET COMBINATION FOR FLY TYING

[76] Inventor: George D. Roberts, 241 Dobbin Rd., St. Louis, Mo. 63119

[21] Appl. No.: 262,748

[22] Filed: Oct. 26, 1988

[51] Int. Cl.[4] ..... A47B 95/00

[52] U.S. Cl. ..... 312/305; 312/330.1

[58] Field of Search ..... 312/305, 330, 309, 270

[56] References Cited

U.S. PATENT DOCUMENTS

| | | | |
|---|---|---|---|
| 2,164,133 | 6/1939 | Efron | 312/305 X |
| 2,461,177 | 2/1949 | Prestien | 312/305 X |
| 2,762,674 | 9/1956 | Sauvago | 312/305 |
| 2,882,114 | 4/1959 | Sease et al. | 312/305 X |
| 3,082,050 | 3/1963 | Baxter et al. | 312/270 X |
| 4,389,077 | 6/1983 | Schmidt | 312/270 X |

*Primary Examiner*—Joseph Falk

*Attorney, Agent, or Firm*—Rogers, Howell & Haferkamp

[57] ABSTRACT

A table and cabinet combination for use in fly tying. The cabinet incorporates a plurality of compartments. Various storage devices particularly suitable for fly tying supplies and impliments fit within the compartments and some can be slid onto the table top for direct accessibility during a fly tying operation. The cabinet also has a plurality of drawers. The table and cabinet combination are of furniture grade construction and finish and can be disassembled for transport between different sites. A tool holder fits within a third of the compartments. The tool holder has a plurality of recesses in a block.

20 Claims, 2 Drawing Sheets

FIG. 1.
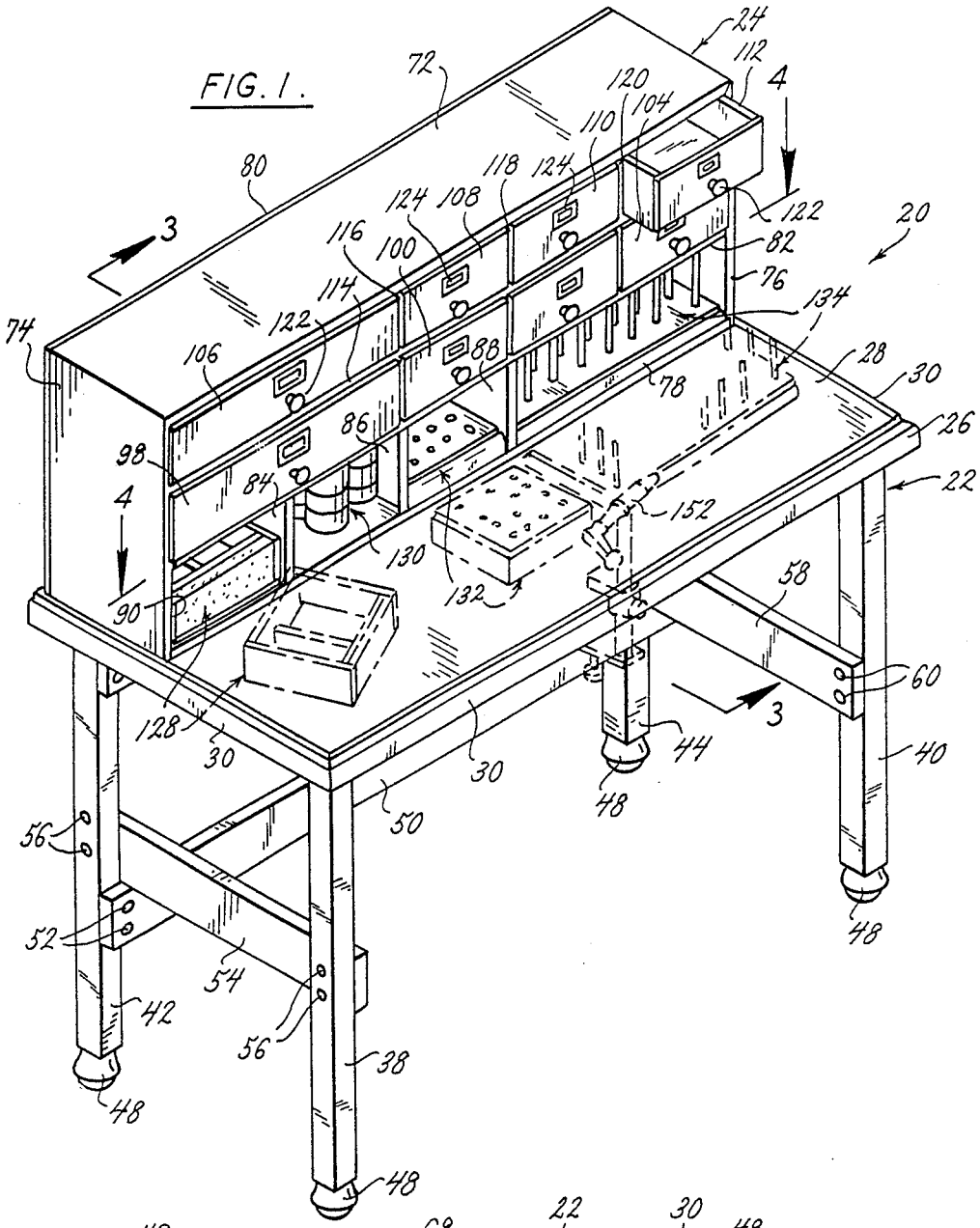
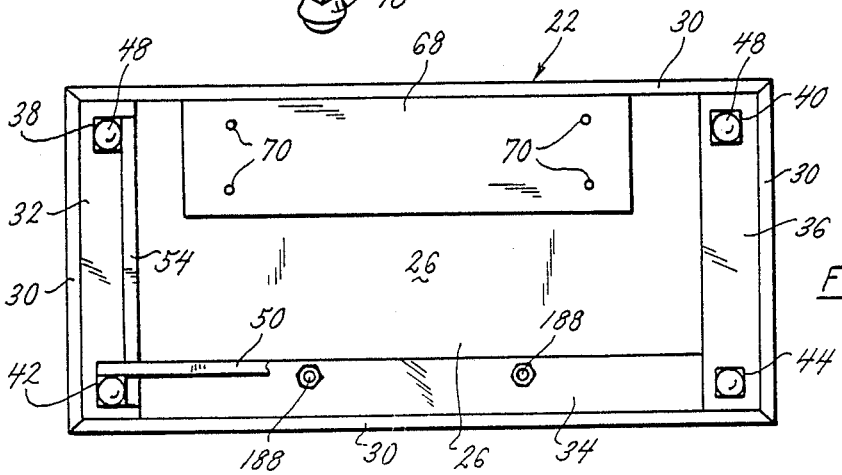
FIG. 2.

TABLE AND CABINET COMBINATION FOR FLY TYING

BACKGROUND OF THE INVENTION

This invention relates to a table and cabinet combination for storing tools, supplies and implements used in fly tying and for use in the making of fish lures. In addition, the table and cabinet combination can accommodate a television set and is conducive to furniture quality construction and finish so that it can be used in a furnished room of a house such as a living room or family room.

Fly tying is a hobby and sometimes a business practiced by a large number of people. Fly tying involves a variety of material, some required and some a result of the fly tyer's creativity. These include many shapes and sizes of hooks, wool, feathers, hair, floss, tinsel, various fabrics, thread, silk, glue, lacquer, and other supplies. The object of course is to fabricate a fish lure that deceives a trout into believing the lure is live bait. In addition, a variety of tools are needed to make the different kinds of fish lures and a vice is needed to hold the hook while the lure is being made.

Typically all these supplies, tools and implements are stored in a haphazard fashion in separate containers scattered about, usually in a basement or an attic, or a room that might best be described as a junk room. In one of these relatively unpleasant and isolated environments, the fly tyer must find something such as a work bench on which to make the fish lures. Since fly tying consumes time and is usually done during evenings and weekends, the typical operation in a basement or attic or junk room separates the fly tyer from his family for extended and repeated periods of time.

There are of course examples in the prior art of work tables and storage cabinets. U.S. Pat. No. 4,659,154 describes and illustrates a storage cabinet which can be used in connection with fly tying. However, this storage cabinet is not convenient for the process of fly tying because the supplies, tools and implements are not handy during the actual fly tying process and, since the storage cabinet is a low chest, it is not well adapted for providing a work top because the fly tyer cannot reasonably or comfortably sit near the work surface. Also, in the cabinet of this patent, there is no coordination between the work area and the storage area whereas in the present invention, all the supplies, tools and implements are immediately accessible to the fly tyer.

Other references disclose various cabinets and tables. These include U.S. Pat. Nos. 2,523,976 which discloses a sewing cabinet, 2,739,863 which discloses a cabinet for artist, 1,954,632 which discloses a desk, and 2,494,528 which discloses a file cabinet. None of these patents discloses a table and cabinet combination that would be useful for fly tying.

SUMMARY OF THE INVENTION

This table and cabinet combination includes a table having a table top supported by four legs and a cabinet supported on the table top. There are braces between the two side legs and between the two back legs, but the front of the cabinet is open so that a person sitting at the table can have his legs extend beneath the table for the greatest comfort as well as to provide accessibility to supplies, tools and implements during tying operations. The legs are fastened to the top by hanger bolts and the braces are fastened to the legs by screws or bolts. There are additional braces between the legs and table top at strategic locations, also fastened in place by screws.

The table is wider than it is deep and a cabinet extends across the rear portion of the top. The cabinet is fastened to the top by lag bolts. Along a lower-most row of the cabinet, there are partitions defining compartments having open fronts. Above the open front compartments, there are rows of drawer supports with rows of drawers slidable in the drawer supports. The drawers have closed fronts and they are intended for storing the various materials and supplies used in making creatively designed fish lures.

An open top tray is slidable into one of the open front compartments. The open top tray has a foam block such as of styrofoam installed across its front for use in temporarily hanging lures. Preferably, the open top tray has a divider separating it into two differently sized compartments and a vice can be stored in the larger of the compartments for removal and connection to the table top. In another of the open front compartments, there is a lazy Susan comprising a disk rotateably mounted from the top of the compartment and supporting the tops of containers. Stackable containers are threaded into the tops and the lazy Susan can be rotated to provide access to any of the stackable containers.

A tool holder is slidable into another of the open front compartments. The tool holder has a plurality of recesses in it for supporting different tools that are useful in fly tying. Some of the recesses are inclined downwardly and rearwardly from their openings so that tools in those recesses will lean forwardly for easy access.

A spool holder comprises a plate on which a plurality of upstanding dowels are mounted. The spool holder is slidable into another of the open front compartments. Some of the dowels are sized so that each will support two standard pools. Other of the dowels are larger to support lead spools.

The open top tray, the tool holder and the spool holder can be kept in their respective compartments for storage purposes and can be readily slid onto the table top during a fly tying operation. Also, the table and cabinet can support a television receiver. The table and cabinet can be built and finished to furniture quality. Yet, the components can be readily disassembled for transportation to a remote location such as a weekend cabin.

BRIEF DESCRIPTION OF THE DRAWINGS

FIG. 1 is a perspective view of the table and cabinet combination.

FIG. 2 is a bottom view of the table and cabinet combination with parts broken away.

DETAILED DESCRIPTION OF THE INVENTION

Figure 3:
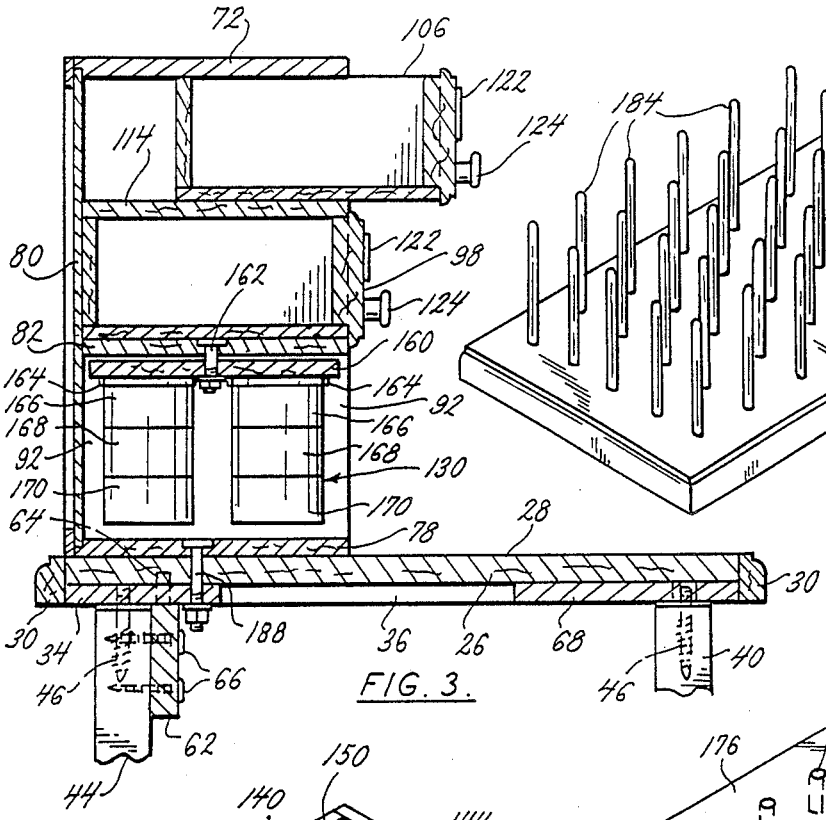
FIG. 3 is an enlarged view in section taken along the plane of the line 3—3 of FIG. 1.

This table and cabinet combination 20 includes a table 22 that supports a cabinet 24. The table 22 has a top 26 that provides a horizontal work surface 28 that preferably is made of furniture grade plywood with matching trim 30 around all its edges. Under the table top 26, there are appropriate filler boards 32, 34, and 36 nailed and glued to the table top 26.

The table top 26 is supported by four legs 38, 40, 42 and 44. Each connected to the top 26 by a hanger bolt 46 so that the legs 38–44 can be removed readily and reinstalled. Each leg 38–44 rests on a caster 48.

There is a lower rear brace 50 that extends between the back legs 42 and 44 and is connected to them by removable screws or bolts 52. Just above the brace 50, there is a side brace 54 connected between the side legs 38 and 42 by screws or bolts 56 and a side brace 58 connected between the side legs 40 and 44 by removable screws or bolts 60. An upper rear brace 62 extends between the rear legs 42 and 44 adjacent their upper ends. There are dowels 64 that are not glued to the top 26, and the brace 62 is fastened to the legs 42 and 44 by removable screws or bolts 66. A counterweight 68 is connected by suitable screws 70 to the underside of the table top 26. The counterweight 68 offsets the weight of the cabinet 24 and prevents the table 22 from tipping.

The cabinet 24 is preferably about as wide as the table top 26 but less than half as deep front to rear. The cabinet 24 is made of wood and includes a top panel 72, side panels 74 and 76, a bottom panel 78 and preferably a rear panel 80. Spaced above the bottom panel 78 is a horizontal partition panel 82 and there are vertical divider panels 84, 86 and 88 between the horizontal panels 78 and 82 that form individual compartments 90, 92, 94 and 96, each having an open front. Above the compartments 90, 92, 94 and 96, there are two rows or drawers 98, 100, 102, 104, 106, 108, 110 and 112 slidably supported within receptacles defined by the horizontal panel 82 and another horizontal panel 114 spaced above it, together with a plurality of vertical partitions 116, 118 and 120. Each drawer has a pull 122 and an index card holder 124 on its front.

An open top tray 128 is slidable within the compartment 90 and can be slid to the position indicated in dotted lines on the table top 28. In the compartment 86, there is a lazy Susan 130. A tool holder 132 is slidable within the compartment 94 and to a position on the table top 28 as indicated in dotted lines. A spool holder 134 occupies the compartment 96 and can be slid to a position on the table top 28 as indicated in dotted lines.

Figure 5:
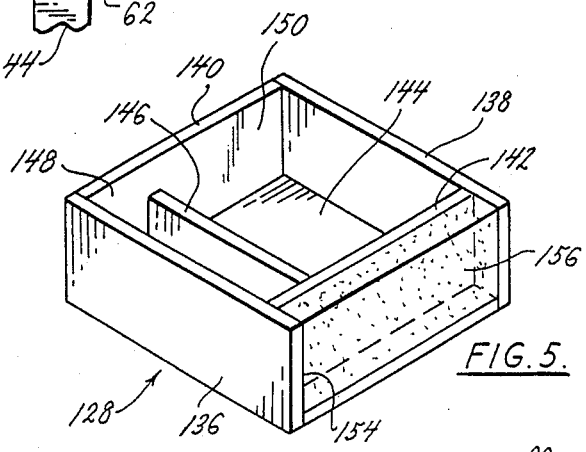
FIG. 5 is a perspective view of the open top tray.

The open top tray 128 is illustrated in more detail in FIG. 5 where it is shown to have side walls 136 and 138, a back wall 140, a recessed forward wall 142, and a bottom wall 144. A partition 146 separates the open top tray into a relatively smaller compartment 148 and a larger compartment 150. The compartment 150 is particularly sized for storing a vice 152 shown in dotted lines in FIG. 1 clamped to the table top 26. The area in front of the forward wall 142 and defined by the side walls 136 and 138 and the bottom wall 144 defines a pocket 154 in which a styrofoam block 156 is removably mounted. The styrofoam block 156 is designed to temporarily support fish hooks and is suitable for hanging flies while they dry.

Figure 4:
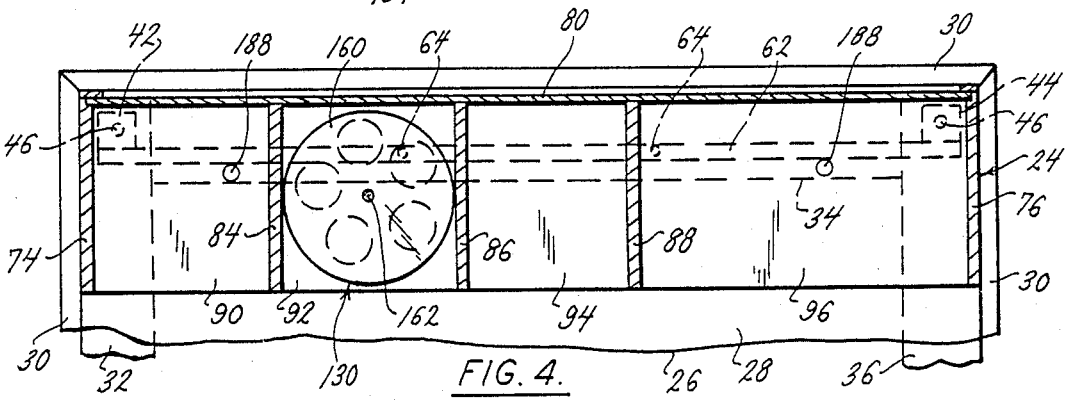
FIG. 4 is an enlarged view in section taken along the plane of the line 4—4 of FIG. 1.

As shown in FIGS. 3 and 4, the lazy Susan 130 comprises a disk 160 that is rotatably supported, such as by a carriage bolt 162 to the top wall 82 that defines the compartment 92. A plurality of container lids 164 are mounted to the underside of the disk 160 and a group of clear plastic stackable containers 166, 168 and 170 are supported from each lid 164. Preferably, there are about 3 to 5 sets of stackable containers 166, 168 and 170.

Figure 6:
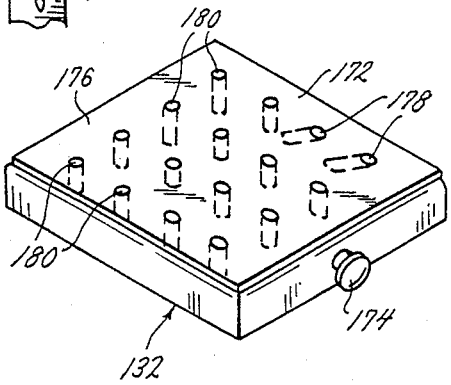
FIG. 6 is a perspective view of the tool holder.

As illustrated in FIG. 6, the tool holder 132 comprises a wood block 172 with a knob 174 mounted on its front. There are a plurality of recesses drilled in the block 172 opening to its upper surface 176. Some of the holes 178 are inclined downwardly and rearwardly whereas others of the holes 180 extend straight down from the top 176. The vertical recesses 180 will support tools in generally upstanding positions whereas the inclined recesses 178 will support tools that extend both upwardly and forwardly toward the user.

Figure 7:
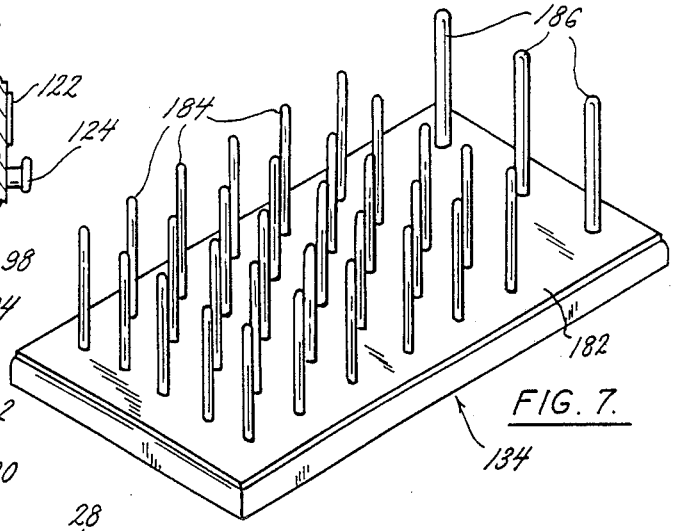
FIG. 7 is a perspective view of the spool holder.

The spool holder 134 is illustrated in FIG. 7. The spool holder comprises a wood plate 182 having a plurality of upwardly extending ¼" dowels 184. Each of the dowels 184 will accommodate two standard spools mounted on it. In addition, the spool holder 134 includes a few (three as illustrated) larger dowels 186 preferably of about ½" in diameter. Each larger dowel 186 supports a lead spool.

The cabinet 24 is connected to the table by suitable bolts 188. These bolts can be removed to separate the cabinet 24 from the table 22.

Operation and Use

It will be apparent from the foregoing description that this table and cabinet assembly 20 is easy to install and accordingly can be disassembled readily for transport to and between locations such as a permanent home and a weekend cabin. By loosening and removing various screws and bolts that have been described, the cabinet 24 can be disconnected from the top 26. Likewise, the legs 38–44 and the braces 50, 54, 56, and 62 can be disassembled. This makes the cabinet and table combination lighter in weight and more compact for easier carrying and transport.

The various drawers 98, 100, 102, 104, 106, 108, 110 and 112 can be filled with different fly tying supplies. The contents can be labeled on cards inserted in the index frames 124. Access to the drawers is convenient to a person sitting at the table 22.

The open top tray 128 contains the more commonly used supplies and the compartment 144 contains the vice 152. In use, the tray 128 can be slid to the dotted line position illustrated in FIG. 1, the vice removed and clamped to the table, with the other compartment 148 remaining readily accessible.

The lazy Susan 130 can contain many different regularly used fly tying supplies. Because of the clear plastic stackable containers 166, 168 and 170 many different fly tying supplies can be stored and upon rotation of the lazy Susan 130, they can selectively be made immediately accessible at the front of the compartment 92.

The tool holder 132 is normally kept in the compartment 94 to store tools therein. During fly tying operations, tool holder 132 can be slid onto the table top such as to the dotted line position illustrated in FIG. 1 where the tools are immediately accessible.

The spool holder 134 can support a large number of standard spools on the dowels 184 and also can store some lead spools on the dowels 186. Ordinarily the spools are stored with the spool holder 134 in the compartment 96, but it can be moved onto the table top 28 during a fly tying operation so that the fly tyer can individually select thread from one of the spools and wind it directly onto a fish lure being made at the vice 44.

Since this table and cabinet combination 20 has a design complementary to living area furniture, is made of furniture grade materials and is finished to furniture grade, it can be left in a living area room such as a living room or a family room. It can support a television receiver so that its use is extended beyond just fly tying and is adapted to family activities as well. This allows the table and cabinet combination 20 to be used by a fly tyer without his being isolated from family members.

Although the dimensions of this table and cabinet combination may be varied as will be apparent to those skilled in the art, some preferable dimensions are set forth. The table top 26 may be about 36–40 inches wide and about 18–22 inches deep. The cabinet 24 may be about 12–15 inches high, about the same width as the table, and about 7–9 inches deep. The compartments 90, 92, 94, and 96 may be about 4–6 inches high. The compartments 90, 92, and 94 each may be about 6–8 inches wide and the compartment 96 about 12–15 inches wide.

There are various changes and modifications which may be made to the invention as would be apparent to those skilled in the art. However, these changes or modifications are included in the teaching of the disclosure, and it is intended that the invention be limited only by the scope of the claims appended hereto.

I claim:

1. A table and cabinet combination for storing fly tying supplies and for use in tying fish lures comprising:

a table top having a work surface, a plurality of legs for supporting the table top with the work surface facing upwardly, a cabinet supported by the work surface, a spool holder having a base and a plurality of dowels projecting upwardly from the base and adapted to receive spools on them, means in the cabinet defining a spool holder compartment having a top, side and bottom walls defining a height and width and adapted for slidable reception of the spool holder within the spool holder compartment whereby when the spool holder is slid into the spool holder compartment the top wall prevents removal of spools from the dowels and when the spool holder is slid from the spool holder compartment spools can be installed on and removed from the dowels, a tool holder comprising a flat tray having a plurality of recesses of various sizes in it for receiving various tools and implements for fly tying, means in the cabinet defining a tool holder compartment having top, side and bottom walls defining a height and width adapted for receiving the tool holder with tools supported in the recesses and projecting upwardly from the tray, means in the cabinet defining a lazy Susan compartment having top, side and bottom walls, A lazy Susan comprising a disk rotateably supported from the top wall of the lazy Susan compartment, a plurality of container lids supported from the bottom of the disk, and a plurality of clear stackable containers removably support by the lids, and a plurality of drawers slidably supported by the cabinet.

2. The table and cabinet combination of claim 1 wherein at least some of the recesses in the tool holder tray are inclined downwardly and rearwardly from their openings through the top of the tray.

3. The table and cabinet combination of claim 1 wherein some of the dowels are of a diameter for receiving standard spools and other of the dowels are of a larger diameter for receiving lead spools.

4. The table and cabinet combination of claim 3 wherein said some dowels each are of a height for receiving two standard spools.

5. The table and cabinet combination of claim 3 wherein said some dowels are about $\frac{1}{4}''$ in diameter and said other dowels are about $\frac{1}{2}''$ in diameter.

6. The table and cabinet combination of claim 1 including:

an open top tray adapted to support fly tying materials and implements, and a rigid foam block fitted to the front of the open top tray for supporting fish hooks, lures, and the like.

7. The table and cabinet combination of claim 6 wherein the foam block is styrofoam and is removable and replaceable with a like foam block.

8. The table and cabinet combination of claim 6 including partition means defining a section of the open top tray for containing a portable vice that can be removed from the open top tray and clamped to the table top.

9. The table and cabinet combination of claim 1 including a counterweight mounted to the underside of the table top adjacent the front thereof for counterbalancing the cabinet.

10. The table and cabinet combination of claim 1 wherein the span of the table top beyond the cabinet is large enough to support a television receiver.

11. The table and cabinet combination of claim 1 wherein the compartments are immediately adjacent and above the table top for easy sliding of objects from the compartments onto the table top, and the drawers are supported above the compartments.

12. The table and cabinet combination of claim 11 wherein there are at least two horizontal rows of drawers one above the other.

13. The table and cabinet combination of claim 1 wherein the cabinet is connected by removable screw fasteners to the table top, a plurality of braces connected by removable screw fasteners to the legs, and screw fasteners for removably connecting the legs to the table top.

14. The table and cabinet combination of claim 13 wherein the span between the front legs is free of a brace.

15. A table and cabinet combination for storing fly tying supplies and for use in tying fish lures comprising:

a table having a generally horizontal working surface, a cabinet supported by the table above the working surface, the depth of the table working surface being greater from front to rear than is the depth of the cabinet and the cabinet being positioned at the rear portion of the working surface, means defining a plurality of compartments in the cabinet, a lazy Susan rotateably supported within a first one of the compartments and rotateably supporting a plurality of clear containers each of which is accessible for removal from the lazy Susan upon rotation of the lazy Susan, an open top tray slidably supported within a second one of said compartments for supporting fly tying components and the like, a tool support tray supported within a third one of the compartments and having a plurality of recesses for retaining various fly tying tools and the like, and a block mounted on the front of one of the trays, the block being of a composition that will permit a fish hook to be stuck in it.

16. The table and cabinet combination of claim 15 including a plurality of drawers slidably supported by the cabinet.

17. The table and cabinet combination of claim 15 wherein the table comprises a table top and at least four legs, a horizontal brace connected between the two rear-most legs and a horizontal brace connected between each rear-most leg and each side leg, the area between the two forward-most legs being free of a horizontal brace enabling the legs of a person sitting on a chair or stool to extend under the table top.

18. The table and cabinet combination of claim 15 including a spool holder slidably supported in a fourth one of the compartments, the spool holder comprising a base and a plurality of dowels projecting upwardly from the base for receiving spools.

19. The table and cabinet combination of claim 15 including partition means dividing the open top tray into at least two compartments one larger than the other for containing a vice, the block being on the front of the open top tray.

20. The table and cabinet combination of claim 15 wherein the working surface extends forward of the cabinet and accommodates a vice.

* * * * *